US009637906B1

(12) United States Patent
Charles

(10) Patent No.: US 9,637,906 B1
(45) Date of Patent: May 2, 2017

(54) URINE ATTACHMENT FOR TOILETS

(71) Applicant: Donald Charles, Stamford, CT (US)

(72) Inventor: Donald Charles, Stamford, CT (US)

( * ) Notice: Subject to any disclaimer, the term of this patent is extended or adjusted under 35 U.S.C. 154(b) by 0 days.

(21) Appl. No.: 14/798,578

(22) Filed: Jul. 14, 2015

(51) Int. Cl.
*E03D 13/00* (2006.01)
*E03D 11/02* (2006.01)

(52) U.S. Cl.
CPC ..... *E03D 13/00* (2013.01); *E03D 11/02* (2013.01)

(58) Field of Classification Search
CPC ..... E03D 11/025; E03D 13/00
See application file for complete search history.

(56) References Cited

U.S. PATENT DOCUMENTS 3,500,480 A * 3/1970 Michal, Jr. ..... E03D 11/025 138/128
5,499,405 A 3/1996 Collins
6,401,263 B2 6/2002 Chang
D471,977 S 3/2003 Levinson
7,228,572 B1 * 6/2007 Holden ..... A47K 11/12 4/144.1
8,424,125 B2 4/2013 Anderson
8,435,934 B2 5/2013 Papari
2010/0037379 A1 2/2010 Hanson
2011/0296602 A1 * 12/2011 Anderson ..... E03D 11/025 4/300.3
2012/0186009 A1 7/2012 Lin
2012/0246816 A1 * 10/2012 Jung ..... A47K 11/12 4/341

* cited by examiner

*Primary Examiner* — Janie Loeppke

(57) ABSTRACT

The urine attachment for toilets is a device that includes a mounting bracket that is configured to attach onto a toilet. The mounting bracket supports a telescoping funnel that is adapted to be urinated in and which directs urine along a conduit, and into a toilet bowl. The mounting bracket includes a mounting member that is adapted to interface with a bottom surface of a toilet tank, and which is affixed to a mounting conduit. The mounting conduit extends from the mounting member over to a rotating disk. The rotating disk is adapted to be positioned adjacent a toilet rim of a toilet bowl. The rotating disk enables the conduit that extends from the telescoping funnel to be adjusted.

9 Claims, 5 Drawing Sheets

URINE ATTACHMENT FOR TOILETS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of toilet accessories, more specifically, a device configured for use with a toilet, and which enables a urine stream to be directed into the toilet.

SUMMARY OF THE INVENTION

The urine attachment for toilets is a device that includes a mounting bracket that is configured to attach onto a toilet. The mounting bracket supports a telescoping funnel that is adapted to be urinated in and which directs urine along a conduit, and into a toilet bowl. The mounting bracket includes a mounting member that is adapted to interface with a bottom surface of a toilet tank, and which is affixed to a mounting conduit. The mounting conduit extends from the mounting member over to a rotating disk. The rotating disk is adapted to be disk enables the conduit that extends from the telescoping funnel to be adjusted.

It is an object of the invention to provide a device that is configured for use with a toilet, and which directs a stream of urine into a toilet.

These together with additional objects, features and advantages of the urine attachment for toilets will be readily apparent to those of ordinary skill in the art upon reading the following detailed description of presently preferred, but nonetheless illustrative, embodiments of the urine attachment for toilets when taken in conjunction with the accompanying drawings.

In this respect, before explaining the current embodiments of the urine attachment for toilets in detail, it is to be understood that the urine attachment for toilets is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the urine attachment for toilets.

It is therefore important that the claims be regarded as including such equivalent construction insofar as they do not depart from the spirit and scope of the urine attachment for toilets. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
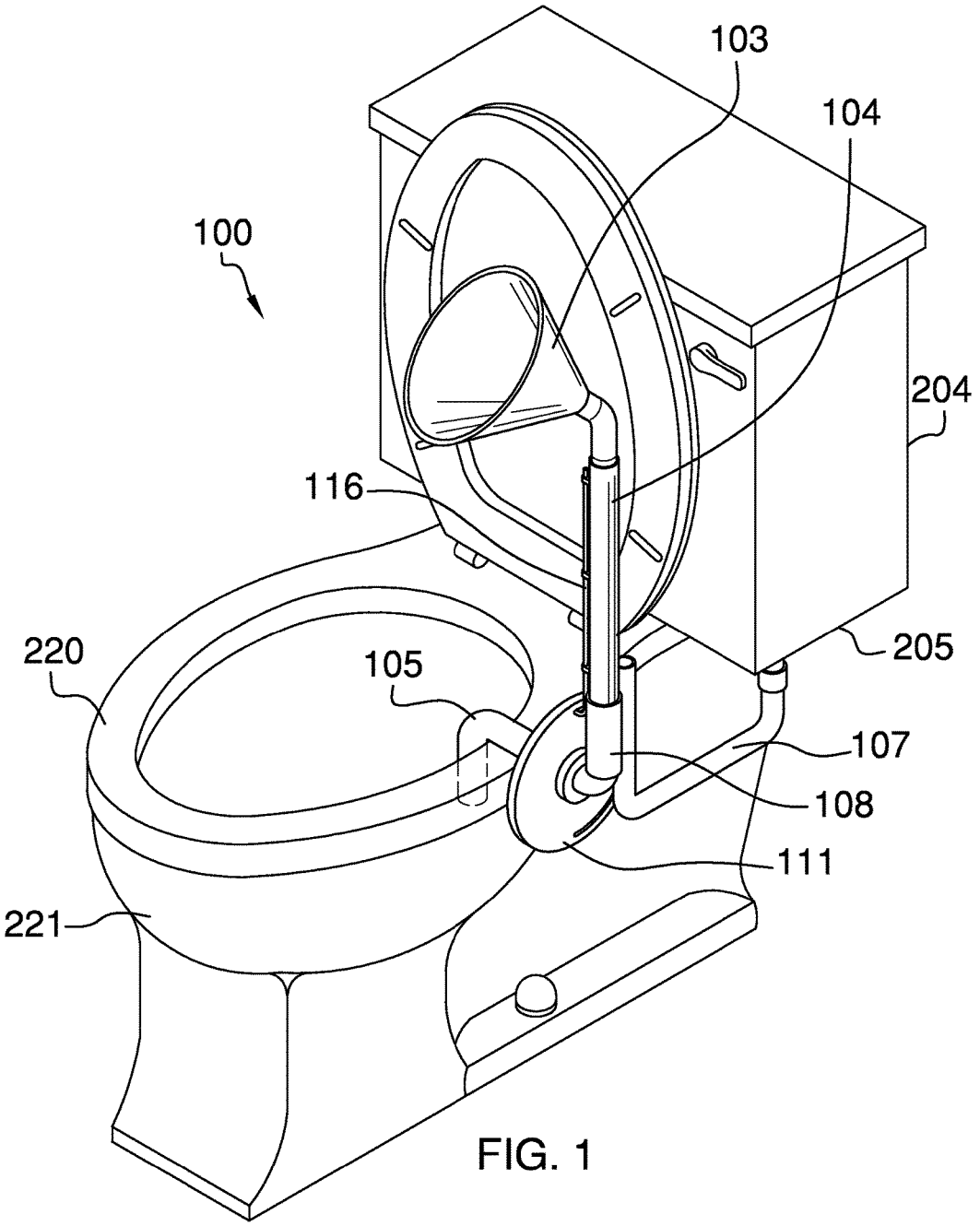
FIG. 1 illustrates a first, perspective view of an embodiment of the disclosure in use.
Figure 2:
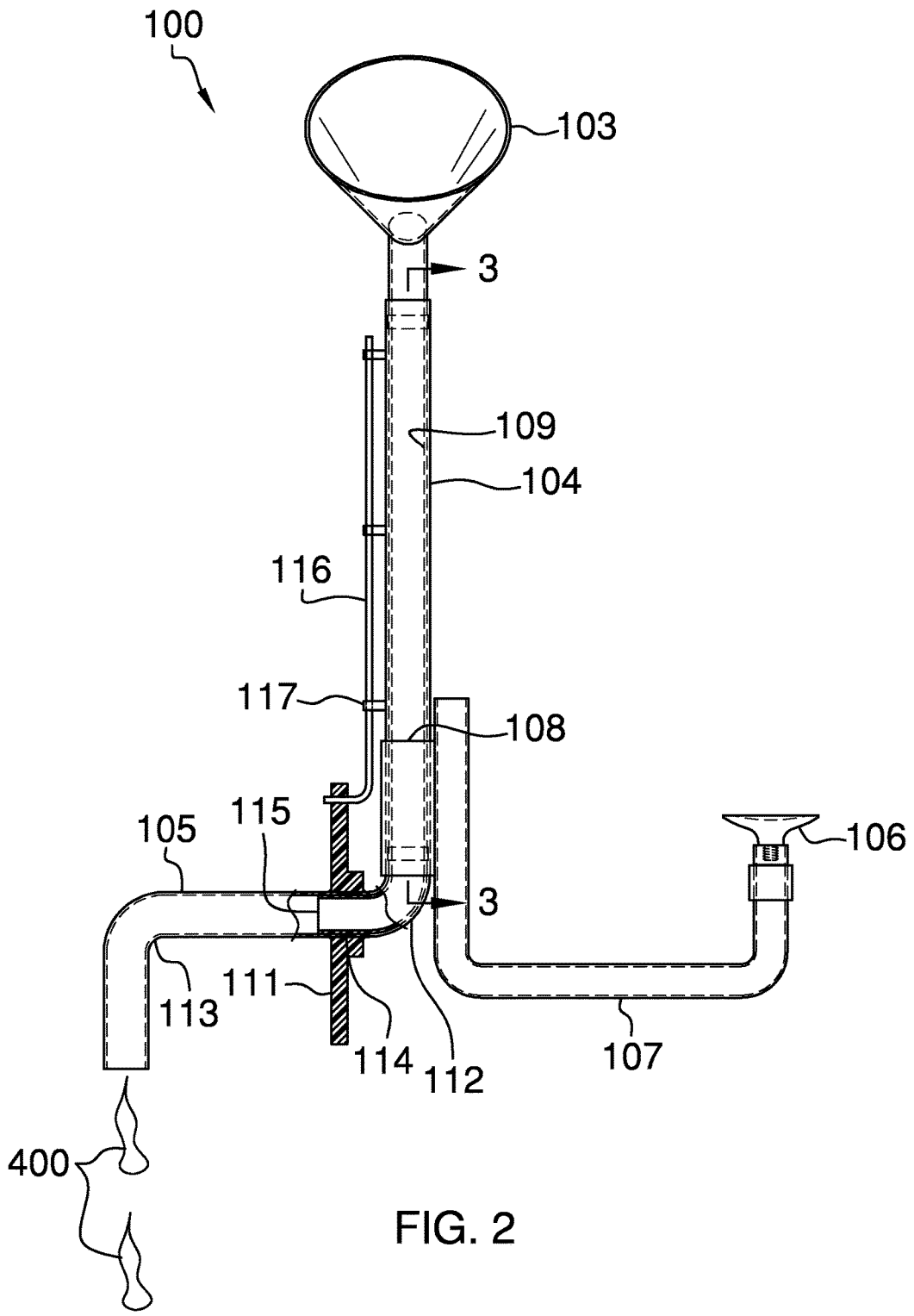
FIG. 2 illustrates a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A urine attachment for toilets 100 (hereinafter invention) is further defined with a mounting bracket 101 that is attached to a telescoping funnel 102. The telescoping funnel 102 is further defined with a funnel member 103 seated atop of a funnel conduit 104. The funnel conduit 104 is vertically oriented, but may be tilted via the mounting bracket 101. The funnel conduit 104 is in fluid communication between the funnel member 103 and an outlet conduit 105.

The mounting bracket 101 is further defined with a mounting member 106 that is adapted to be secured against a bottom tank surface 205 of a toilet tank 204. Moreover, the mounting member 106 is affixed to a mounting bracket 107 that extends over to a mounting collar 108. The mounting bracket 107 is "U" shaped, and is able to pivot with respect to the mounting member 106. The mounting collar 108 enables the funnel conduit 104 to pivot with respect to the mounting collar 108.

Figure 3:
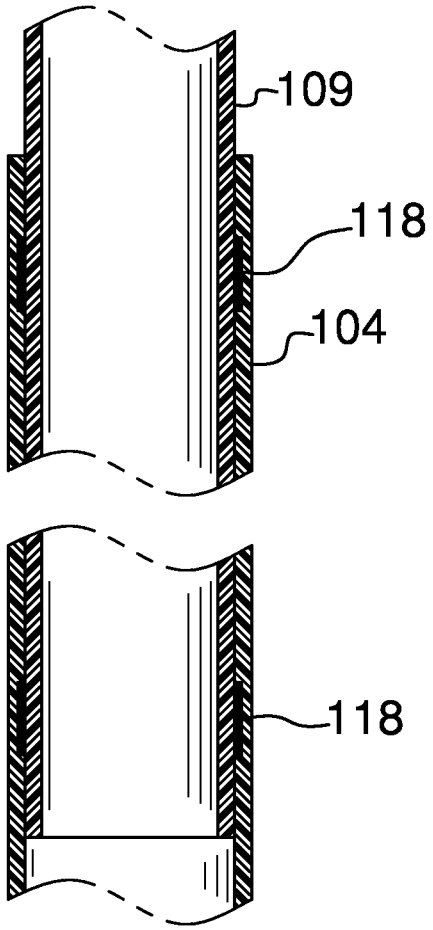
FIG. 3 illustrates a cross-sectional view along line 3-3 in FIG. 2 of an embodiment of the disclosure.
Figure 4:
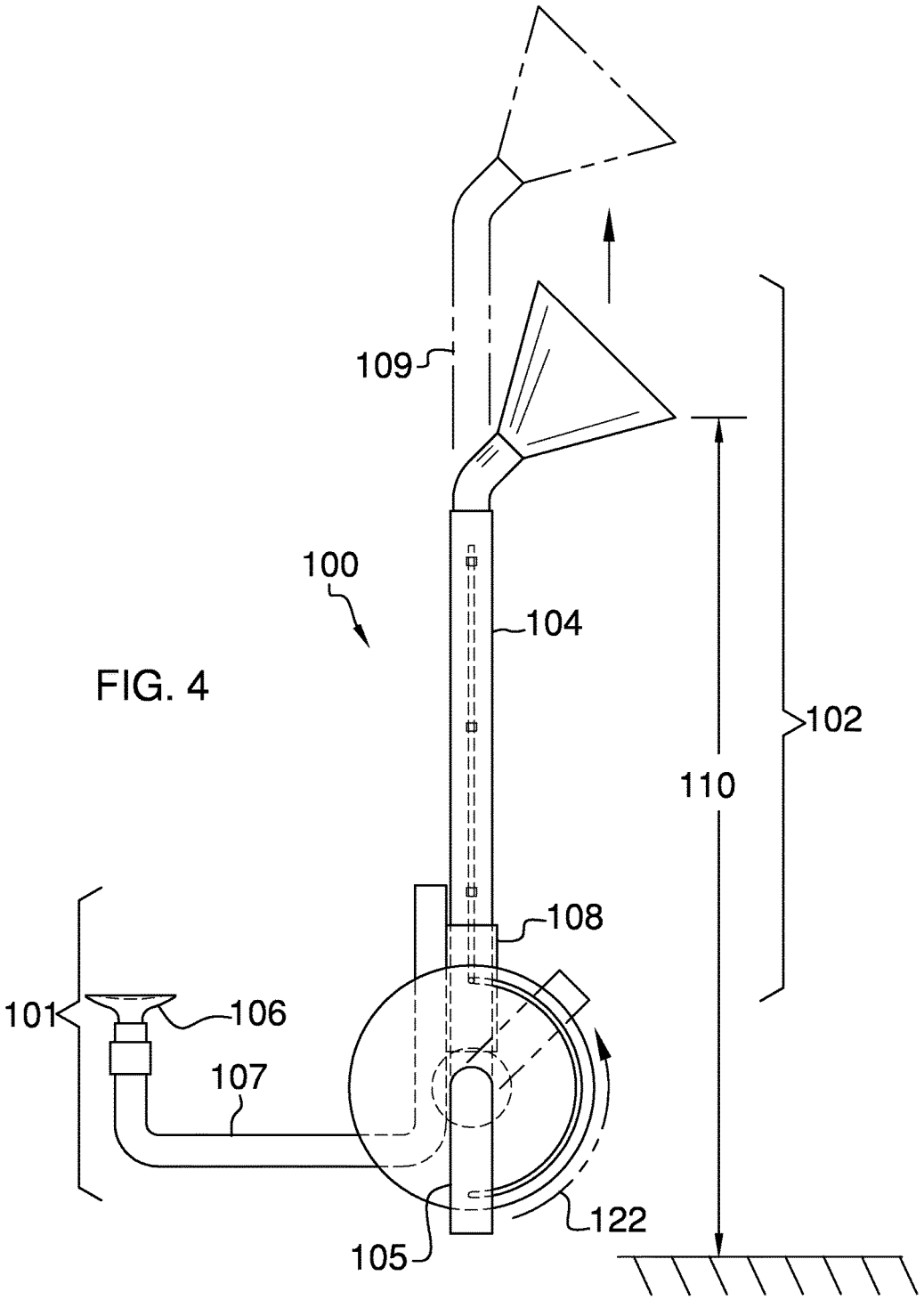
FIG. 4 illustrates a side view of an embodiment of the disclosure in use.
Figure 5:
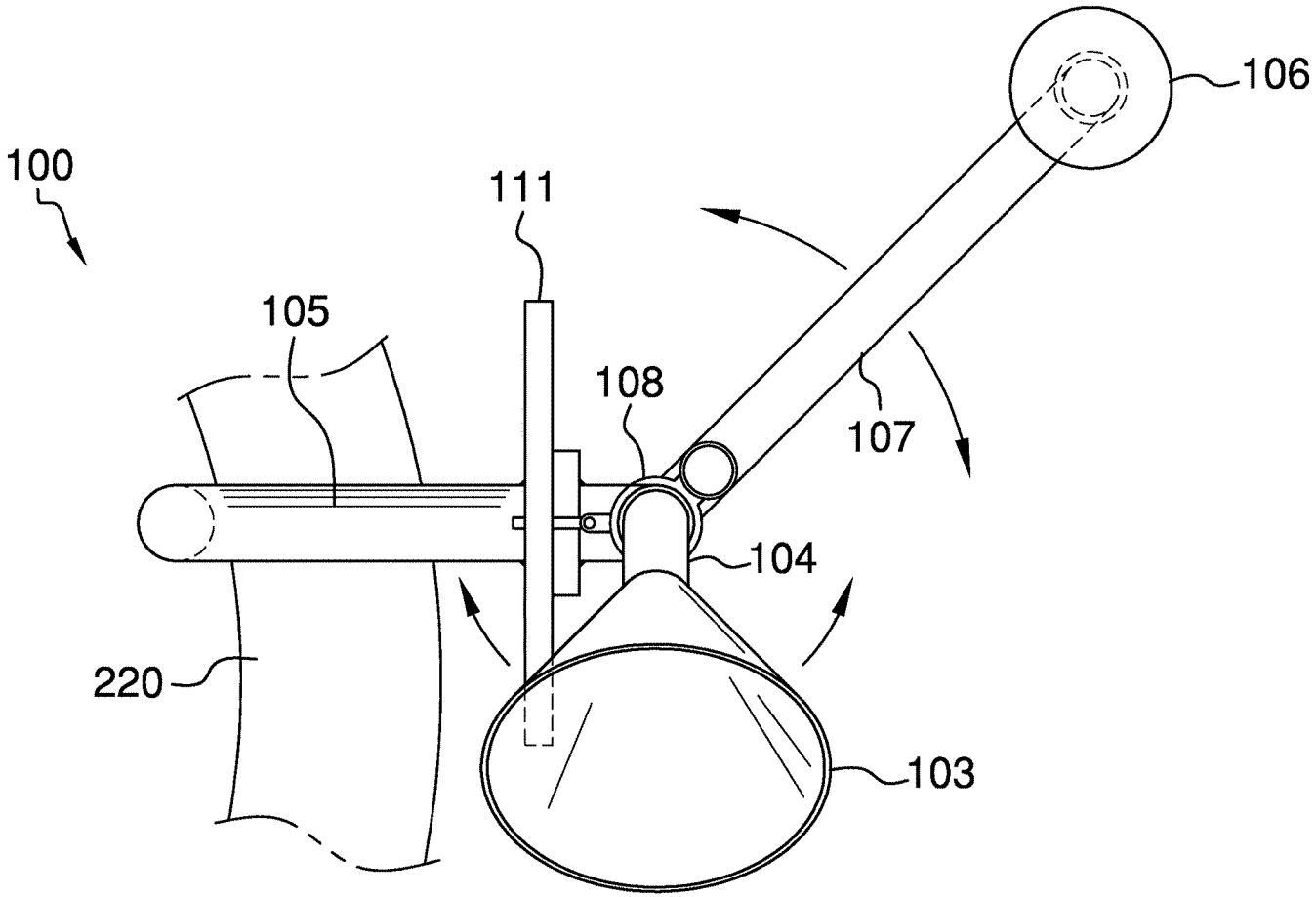
FIG. 5 illustrates a top view of an embodiment of the disclosure in use.

The funnel conduit 104 is further defined with an upper funnel conduit member 109 that is affixed to the funnel member 103. Moreover, the upper funnel conduit member 109 is able to telescope upwardly or downwardly with respect to the funnel conduit 104 in order to adjust a funnel elevation 110. Referring to FIG. 3, the upper conduit member 109 includes at least one secondary gasket member 118 to interface with the funnel conduit 104.

A rotating disk 111 is positioned between the funnel conduit 104 and the outlet conduit 105. The funnel conduit 104 is further defined with a first bottom bend 112 that is adjacent to the rotating disk 111. The outlet conduit 105 is further defined with a second bend 113 that is adjacent to the rotating disk 111. The funnel conduit 104 is connected to the outlet conduit 105 at the rotating disk 111. Moreover, the funnel conduit 104 is slideably engaged within the outlet conduit 105. The rotating disk 111 includes a first gasket 114 where the outlet conduit 105 is positioned within the rotating disk 111. The funnel conduit 104 ceases at a funnel conduit distal end 115, which is nested within the outlet conduit 105.

The rotating disk 111 is attached to a support rod 116 that extends along the funnel conduit 104. The support rod 116 is rigidly affixed to the funnel conduit 104 via rod brackets 117. The outlet conduit 105 is adapted to be positioned above or rest atop of a toilet rim 220 of a toilet bowl 221. The second bend 113 of the outlet conduit 105 is adapted to direct a fluid 400 into the toilet bowl 221. Moreover, the rotating disk 111 enables the outlet conduit 105 to pivot in order to adjust an outlet angle 122.

The funnel member 103 is in fluid communication with the funnel conduit 104. The funnel conduit 104 is in fluid communication with the outlet conduit 105. Fluid communication extends from the funnel member 103 to the outlet conduit 105 such that the fluid 400 being collected in the funnel member 103 is directed out of the outlet conduit 105, and into the toilet bowl 221.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A urine attachment for toilets comprising:

a mounting bracket that is attached to a telescoping funnel;

said mounting bracket is adapted to attach to a toilet in order to support said telescoping funnel;

said telescoping funnel is adapted to receive a fluid, which is transferred via the telescoping funnel into an outlet conduit;

wherein said outlet conduit is adapted to direct said fluid into a toilet bowl;

wherein the telescoping funnel is further defined with a funnel member seated atop of a funnel conduit;

wherein the funnel conduit is vertically oriented;

wherein the funnel conduit is in fluid communication between the funnel member and the outlet conduit;

wherein the mounting bracket is further defined with a mounting member that is adapted to be secured against a bottom tank surface of a toilet tank of said toilet;

wherein the mounting member is affixed to a mounting bracket that extends over to a mounting collar;

wherein the mounting bracket is "U" shaped, and is able to pivot with respect to the mounting member;

wherein the mounting collar enables the funnel conduit to pivot with respect to the mounting collar;

wherein the funnel conduit is further defined with an upper funnel conduit member that is affixed to the funnel member;

wherein the upper funnel conduit member is able to telescope upwardly or downwardly with respect to the funnel conduit in order to adjust a funnel elevation;

wherein the upper conduit member includes at least one secondary gasket member to interface with the funnel conduit;

wherein a rotating disk is positioned between the funnel conduit and the outlet conduit.

2. The urine attachment for toilets as described in claim 1 wherein the funnel conduit is further defined with a first bottom bend that is adjacent to the rotating disk.

3. The urine attachment for toilets as described in claim 2 wherein the outlet conduit is further defined with a second bend that is adjacent to the rotating disk;

wherein the funnel conduit is connected to the outlet conduit at the rotating disk.

4. The urine attachment for toilets as described in claim 3 wherein the funnel conduit is slideably engaged within the outlet conduit; wherein the rotating disk includes a first gasket where the outlet conduit is positioned within the rotating disk.

5. The urine attachment for toilets as described in claim 4 wherein the funnel conduit ceases at a funnel conduit distal end, which is nested within the outlet conduit.

6. The urine attachment for toilets as described in claim 5 wherein the rotating disk is attached to a support rod that extends along the funnel conduit; wherein the support rod is rigidly affixed to the funnel conduit via rod brackets.

7. The urine attachment for toilets as described in claim 6 wherein the outlet conduit is adapted to be positioned above or rest atop of a toilet rim of said toilet bowl; wherein the second bend of the outlet conduit is adapted to direct the fluid into the toilet bowl;

wherein the rotating disk enables the outlet conduit to pivot in order to adjust an outlet angle.

8. The urine attachment for toilets as described in claim 7 wherein the funnel member is in fluid communication with the funnel conduit; wherein the funnel conduit is in fluid communication with the outlet conduit.

9. The urine attachment for toilets as described in claim 8 wherein fluid communication extends from the funnel member to the outlet conduit such that the fluid adaptively being collected in the funnel member is directed out of the outlet conduit, and into the toilet bowl.

* * * * *